US006742375B2

(12) United States Patent
Thudium et al.

(10) Patent No.: US 6,742,375 B2
(45) Date of Patent: Jun. 1, 2004

(54) SYSTEM FOR TRANSPORTING WORKPIECES IN A FORMING PRESS WITH DAMAGE-PREVENTING CROSS TRAVERSE INTERRUPTION APPARATUS

(75) Inventors: Karl Thudium, Waeschenbeuren (DE); Andreas Dangelmayr, Ottenbach (DE)

(73) Assignee: Schuler Pressen GmbH & Co. KG., Goeppingen (DE)

( * ) Notice: Subject to any disclaimer, the term of this patent is extended or adjusted under 35 U.S.C. 154(b) by 0 days.

(21) Appl. No.: 10/233,490

(22) Filed: Sep. 4, 2002

(65) Prior Publication Data

US 2003/0066331 A1 Apr. 10, 2003

(30) Foreign Application Priority Data

Sep. 4, 2001 (DE) ..... 201 14 619

(51) Int. Cl.[7] ..... B21D 55/00; B21D 43/65

(52) U.S. Cl. ..... 72/405.11; 72/405.1; 72/405.01; 72/1; 198/621.1

(58) Field of Search ..... 72/1, 405.01, 405.09, 72/405.1, 405.11, 405.16; 198/621.1, 621.3; 192/129 R

(56) References Cited

U.S. PATENT DOCUMENTS

| | | | | | |
|---|---|---|---|---|---|
| 4,133,199 | A | * | 1/1979 | Shirao | 72/405.16 |
| 4,406,148 | A | * | 9/1983 | Knight | 72/405.13 |
| 4,407,405 | A | * | 10/1983 | Rise | 198/774.1 |
| 4,540,087 | A | * | 9/1985 | Mizumoto | 198/621.1 |
| 4,785,657 | A | * | 11/1988 | Votava | 72/405.14 |
| 5,048,410 | A | * | 9/1991 | Teramoto et al. | 72/405.09 |
| 5,257,899 | A | * | 11/1993 | Asakura et al. | 198/468.4 |

FOREIGN PATENT DOCUMENTS

DE 44 18 417 A1 11/1995

* cited by examiner

*Primary Examiner*—Daniel C. Crane
(74) *Attorney, Agent, or Firm*—Crowell & Moring LLP

(57) ABSTRACT

A system for the transport of workpieces in a forming press, particularly a multistation press, has at least one cross traverse for holding the workpieces, which on at least one of its ends is connected with a lifting and lowering device and can be oriented in a space by the lifting and lowering device. At least one overload protection device is arranged between the cross traverse and the at least one lifting and lowering device for cutting the connection between the cross traverse and the at least one lifting and lowering device.

13 Claims, 5 Drawing Sheets

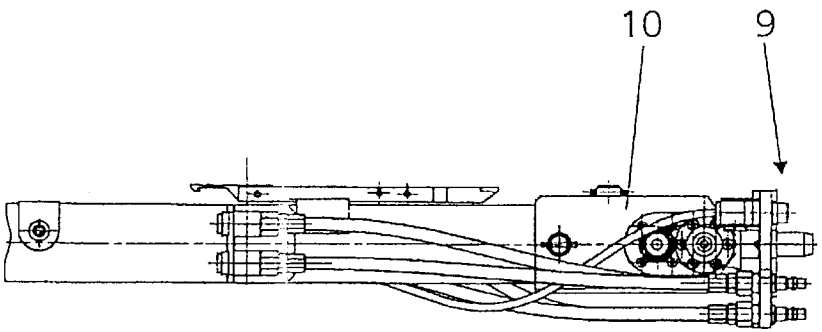
Fig. 4
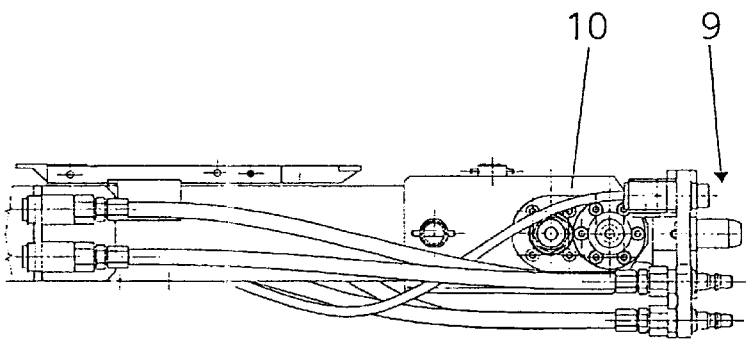
Fig. 5
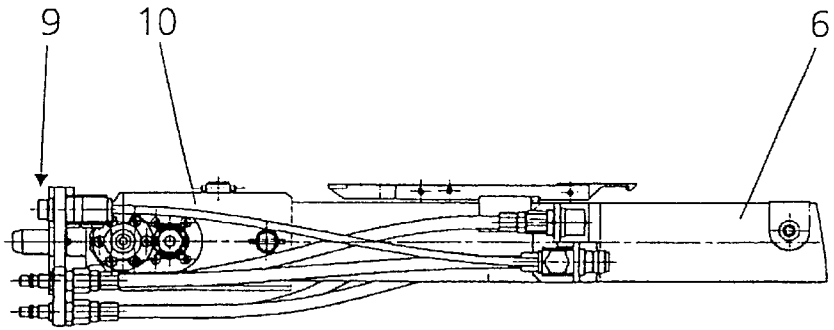
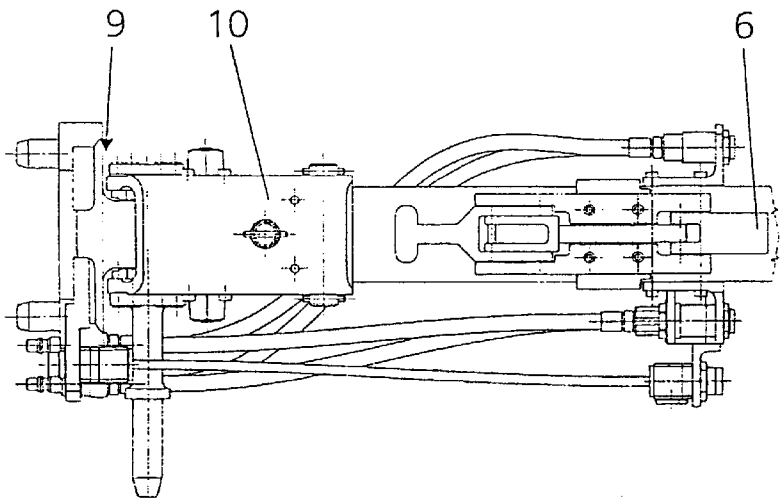

SYSTEM FOR TRANSPORTING WORKPIECES IN A FORMING PRESS WITH DAMAGE-PREVENTING CROSS TRAVERSE INTERRUPTION APPARATUS

This application claims the priority of German Patent Application No. 201 14 619.3, filed Sep. 4, 2001, the disclosure of which is expressly incorporated by reference herein.

BACKGROUND OF THE INVENTION

The present invention relates to a system for transporting workpieces in a forming press, particularly in a multistation press, and, more particularly to a system comprising at least one cross traverse for holding the workpieces, at least one lifting and lowering device operatively connected on at least one end of the at least one cross traverse so that the latter can be oriented in a desired spatial orientation.

A workpiece transport system of this general type is described in DE 44 18 417 A1. In actual use of this known system in a press, however, breakages and other damage to the cross traverse may occur which are usually the result of excessive forces caused by the drives.

Such a destruction of the cross traverses is particularly disadvantageous because, on the one hand, these components are very expensive and, on the other hand, any exchange of the cross traverses represents a considerable time and therefore cost expenditure, particularly because the forming press cannot produce while the exchange is taking place.

SUMMARY OF THE INVENTION

An object of the present invention is, therefore, to provide a system for transporting workpieces in a forming press in which the cross traverse is protected from destruction when used in practice.

According to the invention, this object has been achieved by providing that, between the cross traverse and the at least one lifting and lowering device, at least one overload protection device is arranged for cutting the connection between the cross traverse and the at least one lifting and lowering device.

The overload protection device according to the invention ensures the mechanical connection between the at least one lifting and lowering device and the cross traverse in the normal operation of the forming press. In the event of the occurrence of an excessive loading of the cross traverse and thus an unacceptably high force, the overload protection device is triggered and thereby cuts the mechanical connection between the cross traverse and the at least one lifting and lowering device.

In this manner, a protection of the cross traverse is achieved in the event of overloading, whereby damage to the cross traverse can be avoided and, also when unacceptably high forces occur, which would otherwise result in damage to the cross traverse, only an extremely short stoppage time has to be accepted for the entire forming press.

In order to achieve a still better protection of the cross traverse, an advantageous further development of the invention contemplates that the cross traverse is connected at its two ends with a respective lifting and lowering device, in which case one overload protection device respectively is arranged between the cross traverse and the two lifting and lowering devices.

Furthermore, the at least one lifting and lowering device is capable of moving the cross traverse in the horizontal and vertical direction, and the overload protection device has a horizontal-force overload protection element and a vertical-force overload protection element. As a result, the cross traverse is separately protected from horizontal and vertical overloads, whereby a still better protection is obtained for the cross traverse.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein:

FIG. 4 is a side view of the cross traverse shown in FIG. 3;

FIG. 5 is a plan view of the cross traverse of FIG. 3;

DETAILED DESCRIPTION OF THE DRAWINGS

Figure 1:
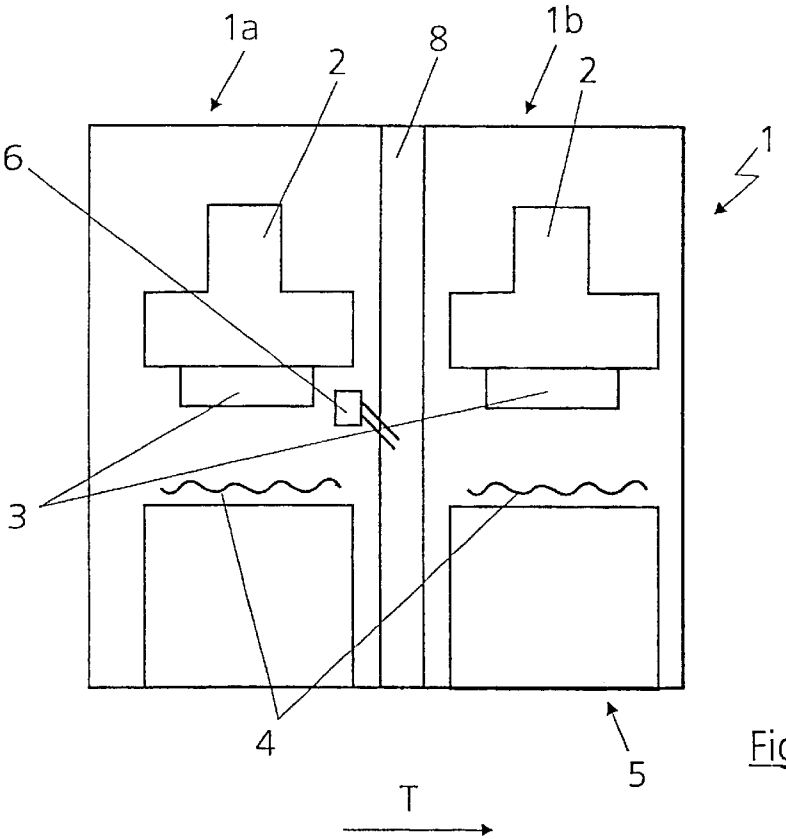
FIG. 1 is a side view of a multistation press with a workpiece transport system according to the present invention.

FIG. 1 is a basic schematic representation of a forming press which is constructed as a multistation press 1 and which, in the illustrated embodiment, has two individual stations 1*a*, 1*b* with corresponding slides 2 which are equipped with tools 3 for forming workpieces 4. For transporting the workpieces 4 from station 1*a* to station 1*b* of the multistation press 1, a workpiece transport system 5 is provided. Of course, the multistation press can also have additional stations 1*a*, 1*b*, . . . with the workpiece transport systems 5 which are arranged in-between and will be described in detail in the following.

Figure 2:
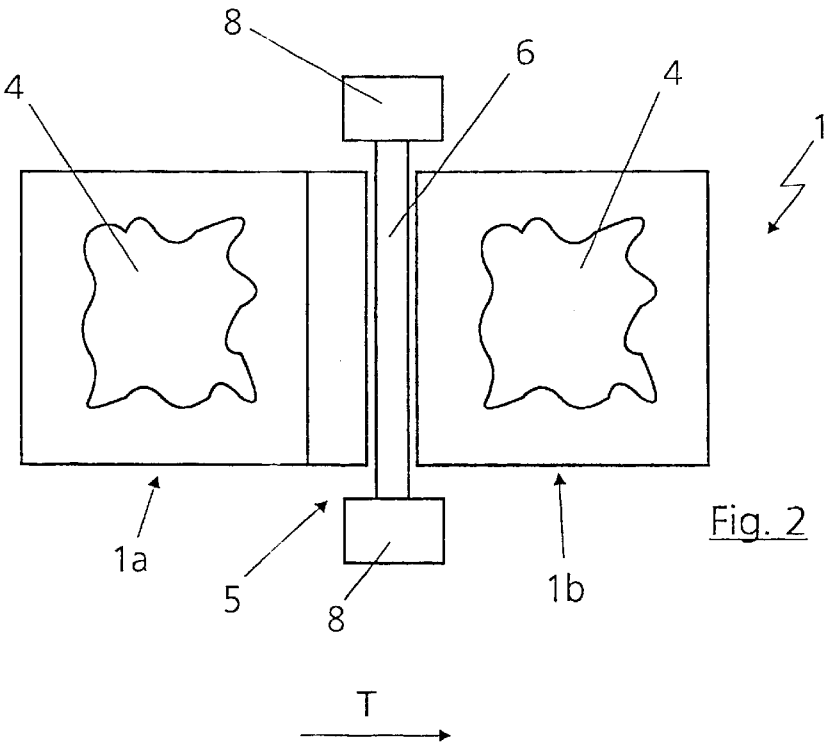
FIG. 2 is a plan view of the multistation press of FIG. 1.

As better illustrated in the also schematic representation according to FIG. 2, each workpiece transport system 5 has a cross traverse 6 which is arranged between stations 1*a*, 1*b* and on whose two ends 6*a*, 6*b* one lifting and lowering device 7, respectively, is arranged. The lifting and lowering devices 7, which are known per se and are therefore not shown in detail, are used for orienting the cross traverse 6 in the space and can move the cross traverse 6 along guiding elements 8 in the horizontal and vertical direction. For this purpose, the lifting and lowering devices 7 have corresponding conventional driving devices which are not shown for ease of understanding the present invention.

In its illustrated unoperated condition, the cross traverse 6 extends at least approximately perpendicular to the transport direction of the workpieces 4 which is marked by the arrow "T" in FIGS. 1 and 2. The cross traverse 6, the lifting and lowering device 7 and the guiding elements 8 therefore form the workpiece transport system 5 for the workpieces 4. The mounting or fastening of the workpieces 4 to the cross traverse 6 not being illustrated because this also takes place in a manner known per se.

The construction of the workpiece transport system 5 and particularly of the cross traverse 6 will now be described with reference to FIGS. 3 to 9.

Figure 3:
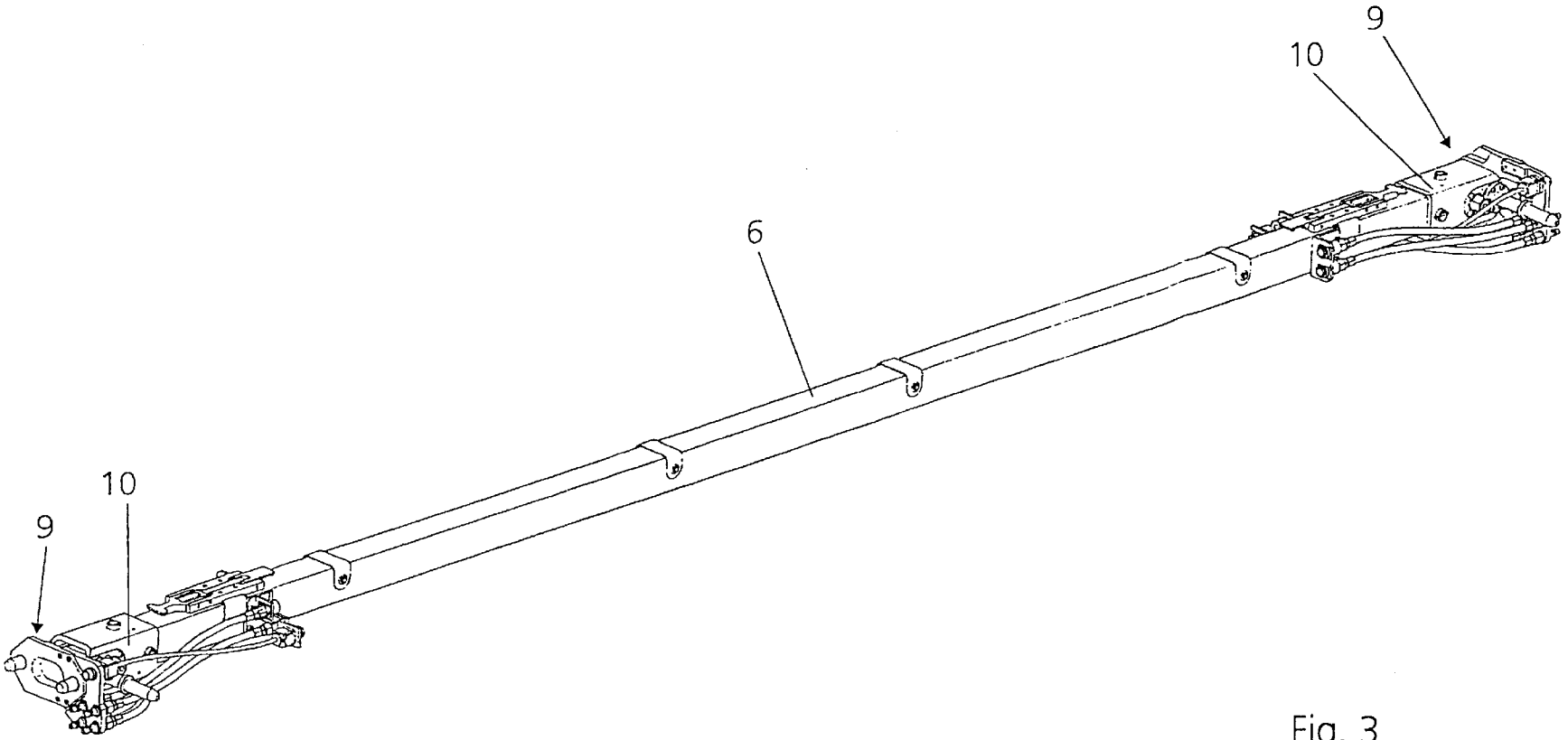
FIG. 3 is a perspective view of a cross traverse of the workpiece transport system of FIGS. 1 and 2.

The perspective representation according to FIG. 3 shows the cross traverse 6 with its two ends 6*a*, 6*b*, on which one overload protection device generally designated by numeral 9 respectively is mounted, which devices 9 are provided for preventing damage, for example, breakages, of the cross traverse 6. Such damage to the cross traverse 6 may otherwise occur as a result of excessive driving forces of the driving devices. In a theoretically conceivable case, in which a lifting and lowering device 7 may be mounted only at one of the ends 6*a* or 6*b*, it is also contemplated that the overload protection device 9 might be mounted only at this one end 6*a* or 6*b* of the cross traverse 6.

Figures 8, 9:
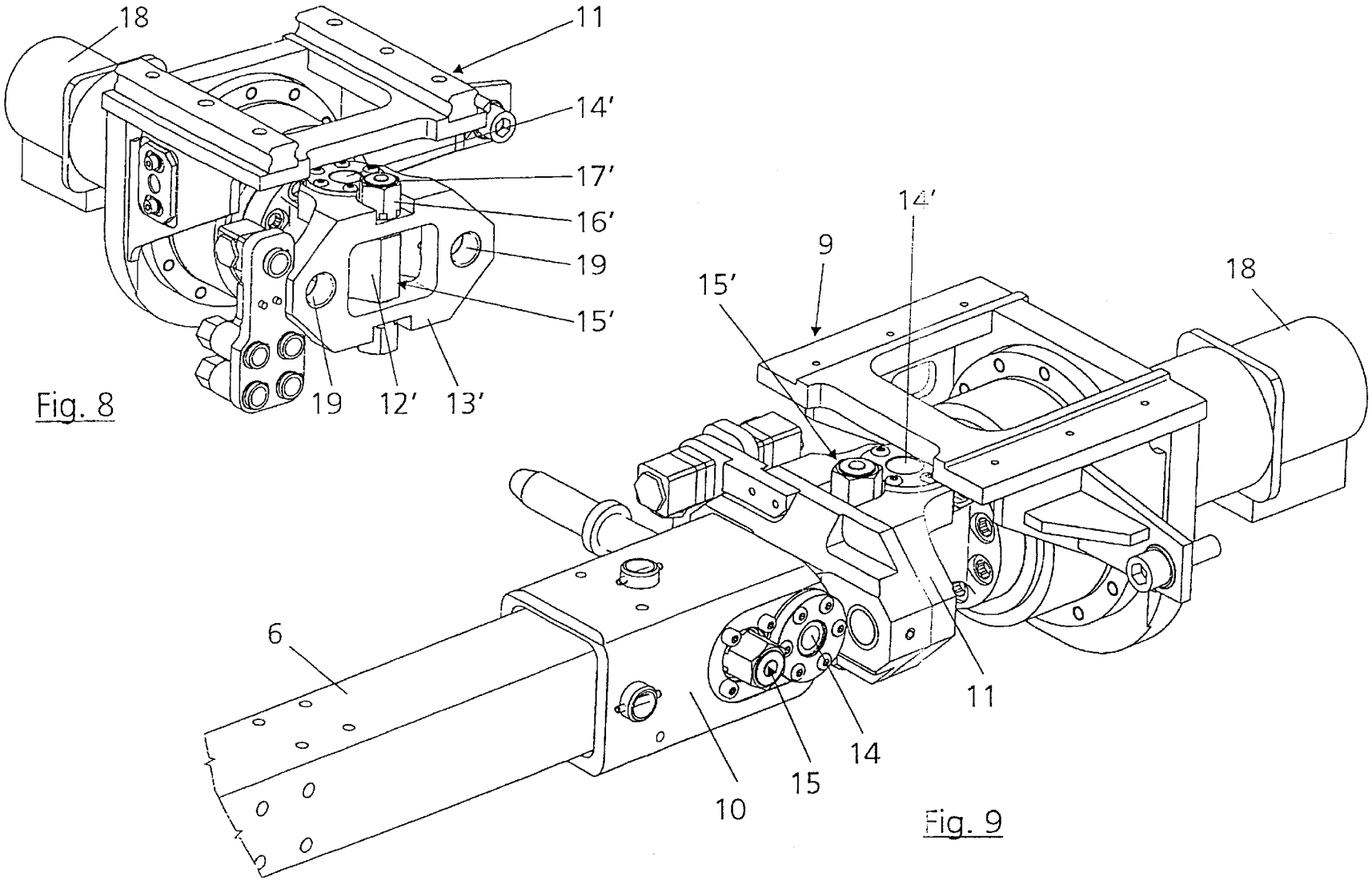
FIG. 8 is a perspective view of the horizontal-force overload protection element of FIG. 7.
FIG. 9 is an assembled perspective view of the two overload protection elements of FIGS. 7 and 8.

Each overload protection device 9 has a vertical-force overload protection element designated generally by numeral 10 which, according to FIG. 3, is mounted directly on the cross traverse 6 or represents a part thereof, and a horizontal-force overload protection element 11 which, as illustrated in FIG. 9, is mechanically connected with the vertical-force overload protection element 10. The horizontal-force overload protection element 11 is provided for preventing the transmission of excessive forces in the horizontal direction, whereas the vertical-force overload protection element 10 acts in the vertical direction. In this manner, the cross traverse 6 is protected from an excessive force in the horizontal as well as in the vertical direction.

Figure 6:
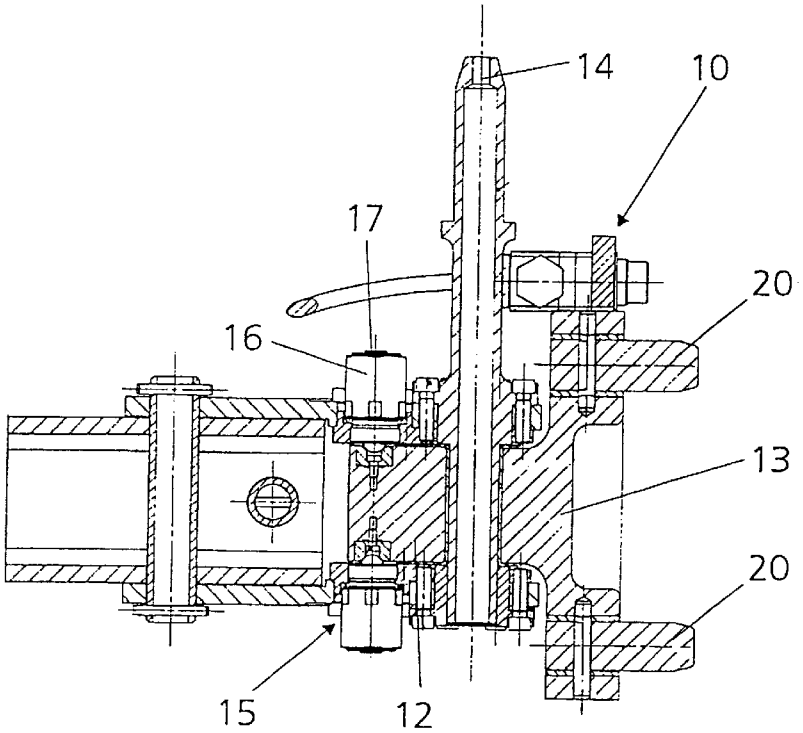
FIG. 6 is a sectional view of a vertical-force overload protection element according to the present invention.

FIGS. 4 and 5 again show the construction of the two vertical-force overload protection elements 10. FIG. 6 is a sectional view of the preferred further development of the vertical-force overload protection element 10.

The vertical-force overload protection element 10 has a first component 12 connected with the cross traverse 6 and a second component 13 which is movable with respect to the first component 12 and which, in the present case, is disposed to be rotatable about an axis of rotation 14. The second component 13 of the vertical-force overload protection element 10 is connected by way of the horizontal-force overload protection element 11 with the lifting and lowering device 7.

In the normal operation of the multistation press 1, the mechanical connection between the first component 12 and the second component 13 is ensured by an overload device 15. When a defined torque is exceeded, the overload device 15 cuts the connection between the first component 12 and the second component 13 and, in this manner, also the connection between the lifting and lowering device 7 and the cross traverse 6 and thereby prevents damage to the cross traverse 6 as a result of possibly excessive forces.

On both sides of the components 12 and 13, the overload device 15 has one locking bolt 16 respectively which, by way of a spring element 17, applies a force upon the two components 12 and 13 for their mutual mechanical connection. As soon as a certain force acting from the first component 12 on the second component 13 is exceeded, the spring elements 17 will no longer be capable of pressing the locking bolts 16 against the components 12 and 13, and the overload device 15 is triggered, whereby no more force can be transmitted from the first component 12 to the second component 13.

Figure 7:
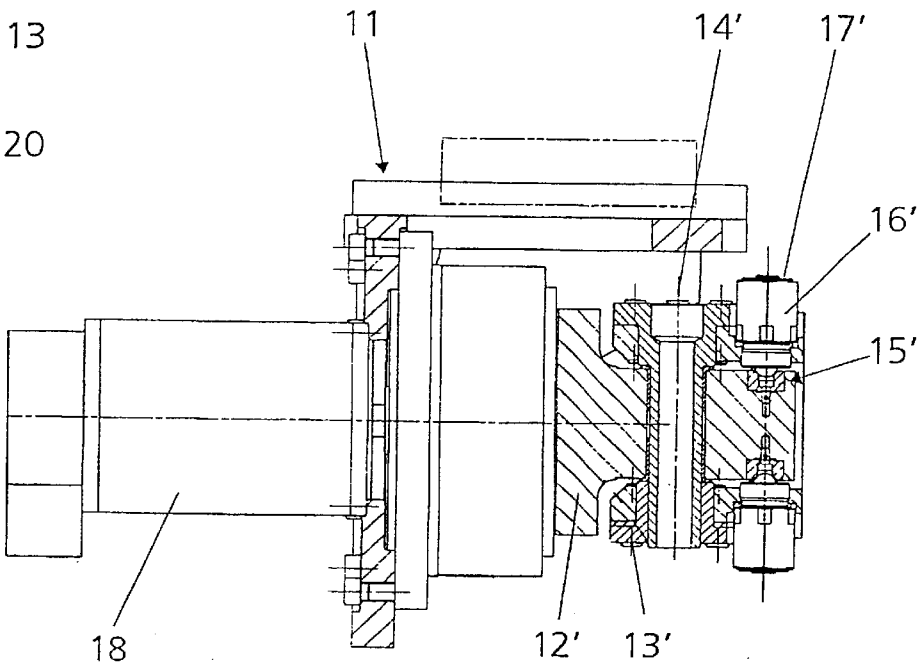
FIG. 7 is a sectional view of a horizontal-force overload protection element according to the present invention.

The horizontal-force overload protection element 11 illustrated in detail in FIGS. 7 and 8 has a construction very similar to the above-described vertical-force overload protection element 10 and also has a first component 12' which, in the present case, is connected directly with a driving device 18, for example, an electric motor. The driving device 18 is used for rotating or twisting the cross traverse 6. The torque applied by the driving device 18 is so low in this case that no protection of the cross traverse 6 is required against an overloading by the driving device 18. Furthermore, a second component 13' s also provided here which is swivellably arranged about an axis 14' of rotation with respect to the fixed component 12'.

An overload device 15' is again provided which has two locking bolts 16' and spring elements 17' acting upon the locking bolts 16'. The method of operation of the overload device 15' is identical with that of the above-described overload device 15, so that here also a triggering of the overload device 15' occurs if the force effect of the lifting and lowering device 7 upon the cross traverse 6 or from the first component 12' onto the second component 13' were to exceed a certain acceptable degree.

For the above-described connection, which is illustrated in FIG. 9, of the vertical-force overload protection element 10 with the horizontal-force overload protection element 11, the first component 12' of the horizontal-force overload protection element 11 has two receiving bores 19 into which two bolts 20 of the second component 13 of the vertical-force overload protection element 10 are pushed, as illustrated in FIG. 9. In this manner, a rigid connection is established between the vertical-force overload protection element 10 and the horizontal-force overload protection element 11, whereby the occurring forces are transmitted in the normal operation of the multistation press 1.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

We claim:

1. A system for transporting workpieces in a forming press, comprising at least one cross traverse for holding the workpieces, at least one lifting and lowering device operatively connected on at least one end of the at least one cross traverse so that the latter can be oriented in a desired spatial orientation, wherein, between the at least one cross traverse and the at least one lifting and lowering device, at least one overload protection device is arranged for interrupting a connection between the at least one cross traverse and the associated at least one lifting and lowering device, wherein, on ends thereof, the at least one cross traverse is operatively connected with a respective at least one of the lifting and lowering devices, and an overload protection device respectively is arranged between the at least one cross traverse and the lifting and lowering devices at each of the ends of the at least one cross traverse.

2. The system according to claim 1, wherein the at least one lifting and lowering device is configured to move the at least one cross traverse in horizontal and vertical directions, and the at least one overload protection device comprises a horizontal-force overload protection element and a vertical-force overload protection element.

3. A system for transporting workpieces in a forming press, comprising at least one cross traverse for holding the workpieces, at least one lifting and lowering device operatively connected on at least one end of the at least one cross traverse so that the latter can be oriented in a desired spatial orientation, wherein, between the at least one cross traverse and the at least one lifting and lowering device, at least one overload protection device is arranged for interrupting a connection between the at least one cross traverse and the associated at least one lifting and lowering device, wherein the at least one lifting and lowering device is configured to move the at least one cross traverse in horizontal and vertical directions, and the at least one overload protection device comprises a horizontal-force overload protection element and a vertical-force overload protection element.

4. The system according to claim 3, wherein the vertical-force overload protection element comprises a first component operatively connected at least indirectly with the at least one cross traverse and a second component which is at least indirectly operatively connected with the respective at least one lifting and lowering device and is configured to be movable relative to the first component, the first component being connected with the second component via an overload apparatus configured such that when a defined force is exceeded, a connection between the first component and the second component is interrupted.

5. The system according to claim 3, wherein the horizontal-force overload protection element comprises a first component operatively connected at least indirectly with the at least one cross-traverse and a second component operatively connected at least indirectly with the respective at least one lifting and lowering device and configured to be movable relative to the first component, the first component being operatively connected with the second component via an overload apparatus configured such that, when a defined force is exceeded, a connection between the first component and the second component is interrupted.

6. The system according to claim 5, wherein the vertical-force overload protection element comprises a first component operatively connected at least indirectly with the at least one cross traverse and a second component which is at least indirectly operatively connected with the respective at least one lifting and lowering device and is configured to be movable relative to the first component, the first component being connected with the second component via an overload apparatus configured such that when a defined force is exceeded, a connection between the first component and the second component is interrupted.

7. The system according to claim 4, wherein the overload device comprises a holding bolt which, by way of at least one spring element, is configured to act upon the two components for the purpose of connecting them.

8. The system according to claim 7, wherein the horizontal-force overload protection element comprises a first component operatively connected at least indirectly with the at least one cross-traverse and a second component operatively connected at least indirectly with the respective at least one lifting and lowering device and configured to be movable relative to the first component, the first component being operatively connected with the second component via an overload apparatus configured such that, when a defined force is exceeded, a connection between the first component and the second component is interrupted.

9. The system according to claim 4, wherein a respective one of the horizontal-force overload protection element and one vertical-force overload protection element is arranged at the ends of the at least one cross traverse, the horizontal-force overload protection element being in an operative engagement with the associated vertical-force overload protection element.

10. The system according to claim 9, wherein the horizontal-force overload protection element comprises a first component operatively connected at least indirectly with the at least one cross-traverse and a second component operatively connected at least indirectly with the respective at least one lifting and lowering device and configured to be movable relative to the first component, the first component being operatively connected with the second component via an overload apparatus configured such that, when a defined force is exceeded, a connection between the first component and the second component is interrupted.

11. The system according to claim 10, wherein the overload device comprises a holding bolt which, by way of at least one spring element, is configured to act upon the two components for the purpose of connecting them.

12. The system according to claim 9, wherein, for operatively connecting the horizontal-force overload protection element with the associated vertical-force overloading protection element, one of the components has at least one bolt arranged to engage in at least one corresponding receiving bore of the other of the components.

13. The system according to claim 3, wherein, for operatively connecting the horizontal-force overload protection element with the associated vertical-force overloading protection element, one of the components has at least one bolt arranged to engage in at least one corresponding receiving bore of the other of the components.

* * * * *